US010646790B2

(12) United States Patent
Choi

(10) Patent No.: US 10,646,790 B2
(45) **Date of Patent: *May 12, 2020**

(54) POP-UP TOY

(71) Applicant: CHOIROCK CONTENTS FACTORY CO., LTD., Seoul (KR)

(72) Inventor: Jong-Ill Choi, Seoul (KR)

(73) Assignee: CHOIROCK CONTENTS FACTORY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/570,524

(22) PCT Filed: Feb. 19, 2016

(86) PCT No.: PCT/KR2016/001659

§ 371 (c)(1),
(2) Date: Oct. 30, 2017

(87) PCT Pub. No.: WO2016/182175

PCT Pub. Date: Nov. 17, 2016

(65) Prior Publication Data

US 2018/0147502 A1 May 31, 2018

(30) Foreign Application Priority Data

May 11, 2015 (KR) ..... 10-2015-0065525

(51) Int. Cl.
*A63F 1/04* (2006.01)
*A63H 33/00* (2006.01)
(Continued)

(52) U.S. Cl.
CPC ..... *A63H 33/003* (2013.01); *A63H 3/04* (2013.01); *A63H 3/16* (2013.01); *A63H 33/18* (2013.01); *A63H 33/26* (2013.01)

(58) Field of Classification Search
CPC ..... A63H 33/003; A63H 3/04; A63H 3/16; A63H 33/18; A63H 33/26
(Continued)

(56) References Cited

U.S. PATENT DOCUMENTS 8,348,715 B2 * 1/2013 Miyake ..... A63H 33/003 446/321
8,517,791 B2 * 8/2013 Yamada ..... A63H 33/26 446/129
(Continued)

FOREIGN PATENT DOCUMENTS

JP 2011-62400 A 3/2011
KR 1999-0065295 A 8/1999
(Continued)

OTHER PUBLICATIONS

International Search Report dated Jun. 1, 2016, in corresponging International Application No. PCT/KR2016/001659 (2 pages in English, 2 pages in Korean).

*Primary Examiner* — Vishu K Mendiratta
(74) *Attorney, Agent, or Firm* — NSIP Law

(57) ABSTRACT

The present invention relates to a pop-up toy which is mounted at a random location, operates by means of a moving object which moves from outside, and thus transforms from a first from into a second form, thereby enhancing amusement of the play.

10 Claims, 8 Drawing Sheets

(51) Int. Cl.

| | |
|---|---|
| ***A63H 3/04*** | (2006.01) |
| ***A63H 3/16*** | (2006.01) |
| ***A63H 33/18*** | (2006.01) |
| *A63H 33/26* | (2006.01) |

(58) Field of Classification Search
USPC ..... 446/273, 276, 282, 284, 285, 295, 298, 446/300, 309, 310, 313, 339, 340, 354, 446/376, 377, 378
See application file for complete search history.

(56) References Cited

U.S. PATENT DOCUMENTS

| | | | | |
|---|---|---|---|---|
| 2010/0252990 | A1* | 10/2010 | Yamada ..... | A63H 33/003 273/108 |
| 2011/0269366 | A1* | 11/2011 | Sugimoto ..... | A63H 33/003 446/72 |
| 2013/0324001 | A1* | 12/2013 | Yamada ..... | A63H 33/003 446/72 |
| 2016/0045835 | A1* | 2/2016 | Choi ..... | A63H 33/003 446/456 |

FOREIGN PATENT DOCUMENTS

| | | | |
|---|---|---|---|
| KR | 10-2013-0097615 | A | 9/2013 |
| KR | 10-2013-0108940 | A | 10/2013 |
| KR | 10-1370617 | B1 | 3/2014 |

* cited by examiner

POP-UP TOY

CROSS REFERENCE TO RELATED APPLICATIONS

This application is a U.S. National Stage Application of International Application No. PCT/KR2016/001659, filed on Feb. 19, 2016, which claims the benefit under 35 USC 119(a) and 365(b) of Korean Patent Application No. 10-2015-0065525, filed on May 11, 2015, in the Korean Intellectual Property Office.

TECHNICAL FIELD

The present invention relates to a pop-up toy, and more particularly, to a pop-up toy which is located at a given position, operates by means of a moving object which moves from the outside, and thus transforms from a first from into a second form.

BACKGROUND ART

Generally, a transforming toy has a body having a form of a robot or car and transforms into the robot or car form from an arbitrary form. As the single toy transforms into other forms, children can enjoy a variety of plays.

According to the conventional transforming toy, however, the transforming process is carried out by means of a user's manual manipulation, and if the play time with the transforming toy is long, the user's excitement may be decreased.

On the other hand, there is suggested a shooting play for providing a lot of fun, wherein a moving object like a marble, medal, disc and so on is shot toward a target located on a given position so as to make the target fall down.

Such shooting play is carried out by just shooting the moving object toward the target, but unfortunately, it does not provide the fun occurring at the time when the moving object hits the target.

Recently, there has been suggested a shooting toy that is provided with a camera mounted thereon in such a manner as to be controlled remotely by a controller to transfer the image signals of the images acquired thereby to the controller and a monitor connected to the controller to display the acquired images on the basis of the image signals.

Another conventional shooting toy is disclosed in Korean Patent No. 10-1050043 (entitled "shooting toy"), wherein it is determined whether shooting is done well using image recognition.

According to the conventional shooting toys, however, it is determined whether shooting is done well using the image recognition, so that the shooting toys are complicated in configurations and are raised in manufacturing costs.

DISCLOSURE

Technical Problem

Accordingly, the present invention has been made in view of the above-mentioned problems occurring in the prior art, and it is an object of the present invention to provide a pop-up toy which is located at a given position, operates by means of a moving object which moves from the outside, and thus transforms from a first from into a second form.

Technical Solution

To accomplish the above object, according to the present invention, there is provided a pop-up toy including a body having a given form, a plurality of body parts rotatably coupled to the body, and a first locking part adapted to fix the plurality of body parts to the body to allow the outer form of the pop-up toy to be maintained to a given first form, wherein if the first locking part is operated and thus released from the locked state by means of a moving object to the pop-up toy from the outside, at least one or more body parts of the plurality of body parts fixed to the pop-up toy are popped up to allow the outer form of the pop-up toy to transforms into a second form from the first form.

According to the present invention, desirably, the pop-up toy is located at an arbitrary position.

According to the present invention, desirably, if the first locking part is released from the locked state by means of the moving object, an arbitrary body part of the plurality of body parts fixed to the pop-up toy rotates to allow the pop-up toy to transform into the second form or to allow the body of the pop-up toy to fall to one side through the pressurization against ground.

According to the present invention, desirably, the pop-up toy further includes a second locking part adapted to be released from a locked state if the body falls to one side and is thus developed to come into contact with the ground, wherein if the second locking part is released from the locked state through the contact with the ground, at least one or more body parts of the plurality of body parts fixed to the pop-up toy rotate to allow the pop-up toy to transform into the second form, to allow the body of the pop-up toy to be popped up to stand up through the pressurization against the ground, or to allow a portion of the body of the pop-up toy to be thrown or shot toward the outside of the body.

According to the present invention, desirably, the moving object has a magnetic material disposed in the interior thereof.

According to the present invention, desirably, the first locking part has a magnet mounted thereon in such a manner as to be operated through the attraction caused by the magnetic field with the magnetic material of the moving object and thus released from the locked state thereof.

According to the present invention, desirably, the first locking part is operated through the physical contact with the moving object and is thus released from the locked state thereof.

According to the present invention, desirably, the first locking part has a magnet mounted thereon in such a manner as to form a magnetic field together with the magnetic material of the moving object to allow the moving object physically contacted therewith to be attached to the pop-up toy.

According to the present invention, desirably, the pop-up toy further includes a stopper located under the first locking part to limit the movement of the moving object.

According to the present invention, desirably, the first form is at least one selected from mask, combat helmet, shield, car, building, and object forms.

According to the present invention, desirably, the second form is at least one selected from animal, robot, human, and animation character forms.

Advantageous Effects

According to the present invention, the pop-up toy is located at a given position, operates by means of the moving object which moves from the outside, and thus transforms from the first from into the second form, thereby enhancing the excitement of the play.

MODE FOR INVENTION

Hereinafter, an explanation on a pop-up toy according to the present invention will be in detail given with reference to the attached drawing.

First Embodiment

Figure 1:
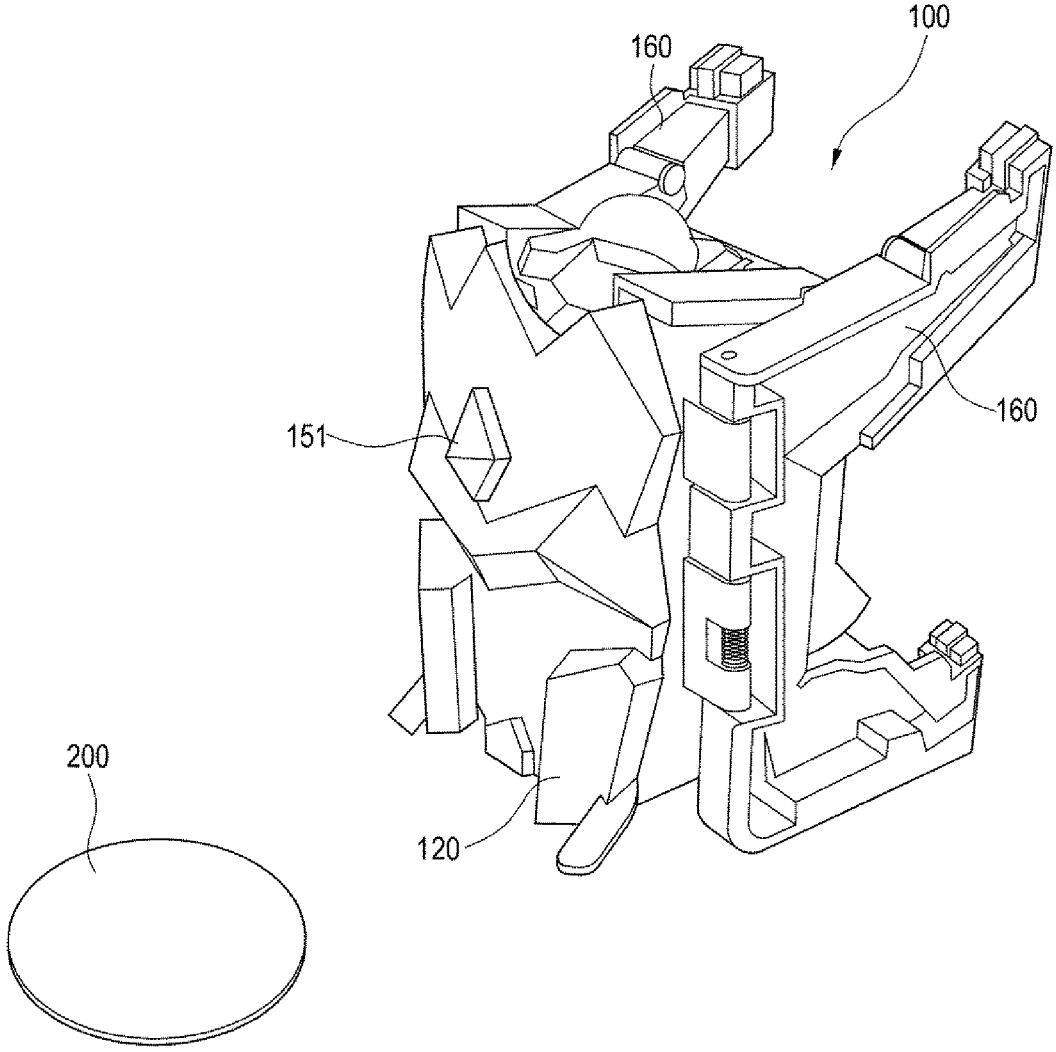
FIG. 1 is a perspective view showing a pop-up toy according to a first embodiment of the present invention.
Figure 2:
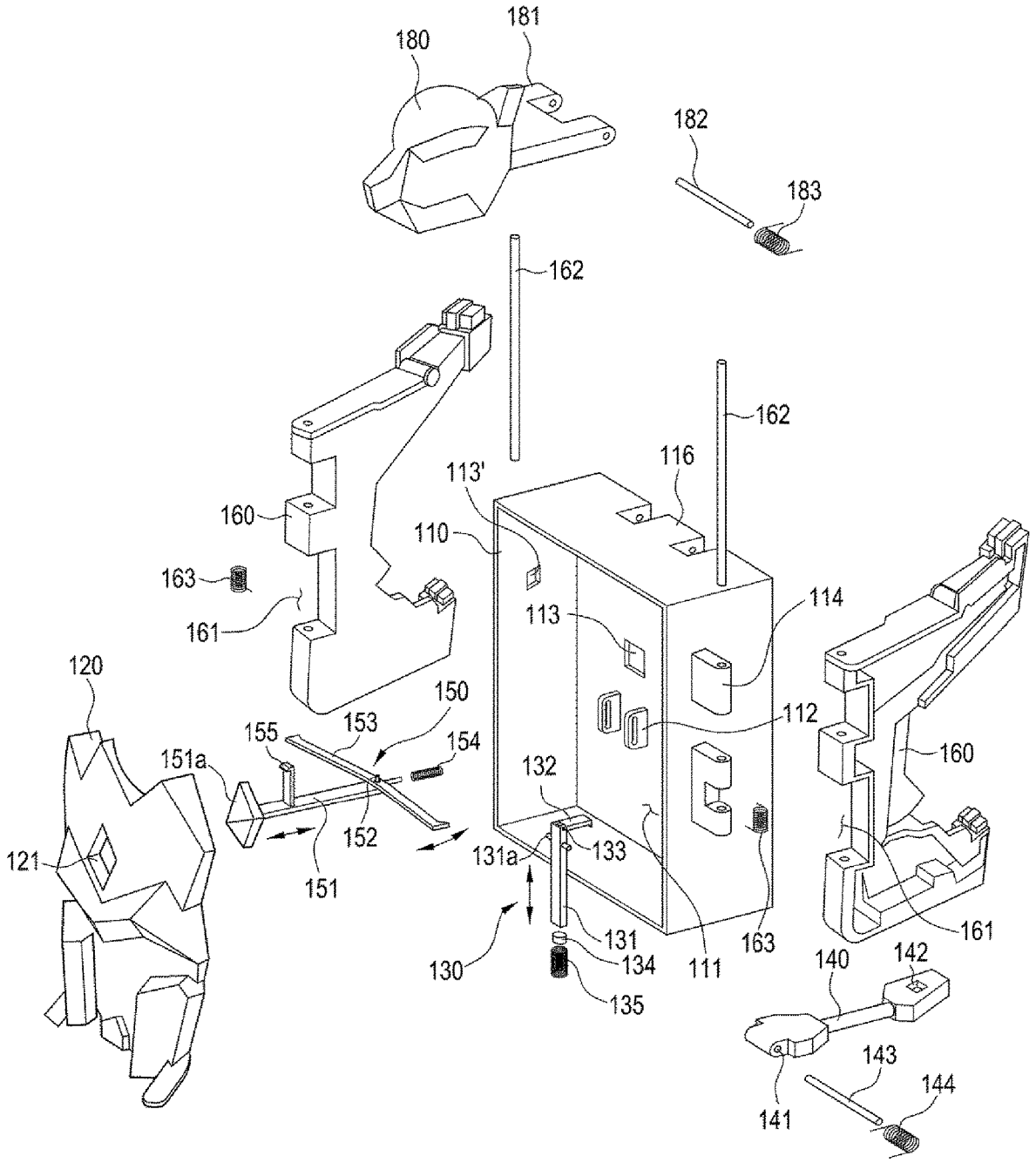
FIG. 2 is an exploded perspective view showing the components of the pop-up toy of FIG. 1.
Figure 3:
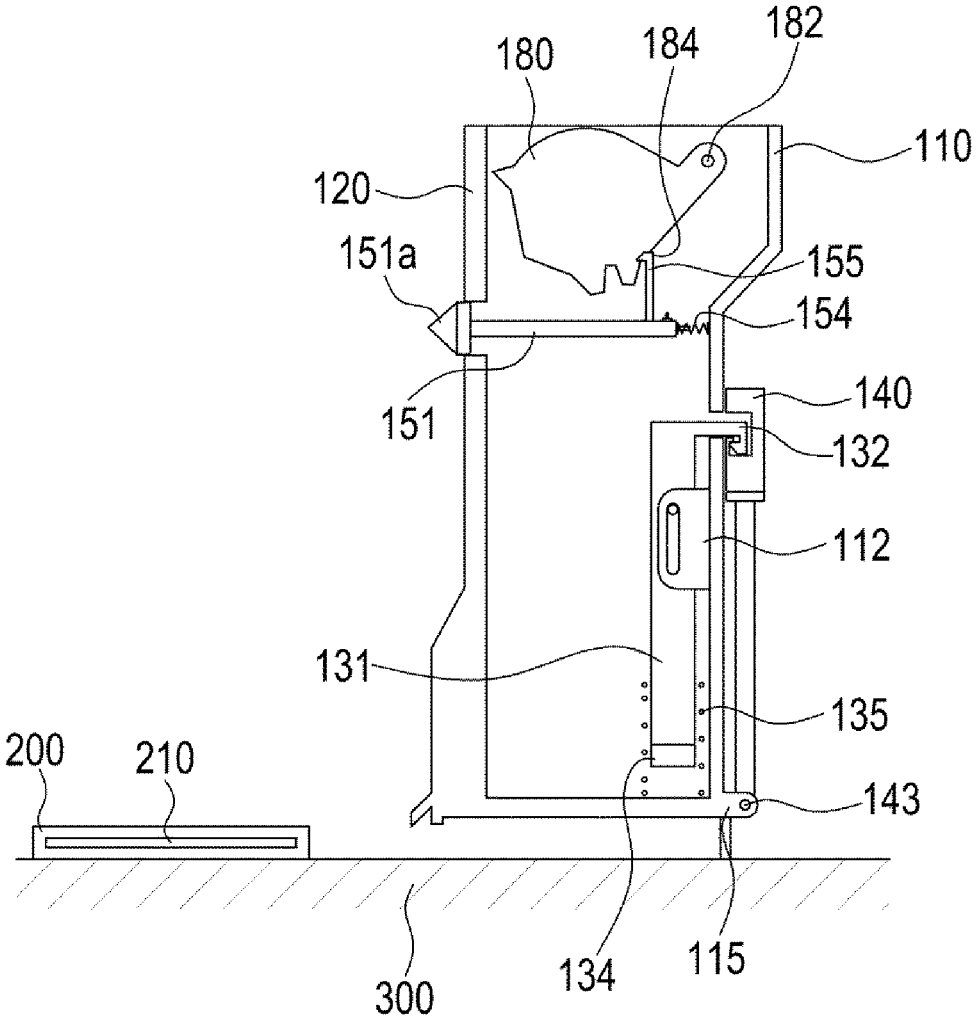
FIG. 3 is a sectional view showing the configuration of the pop-up toy of FIG. 1.
Figure 4:
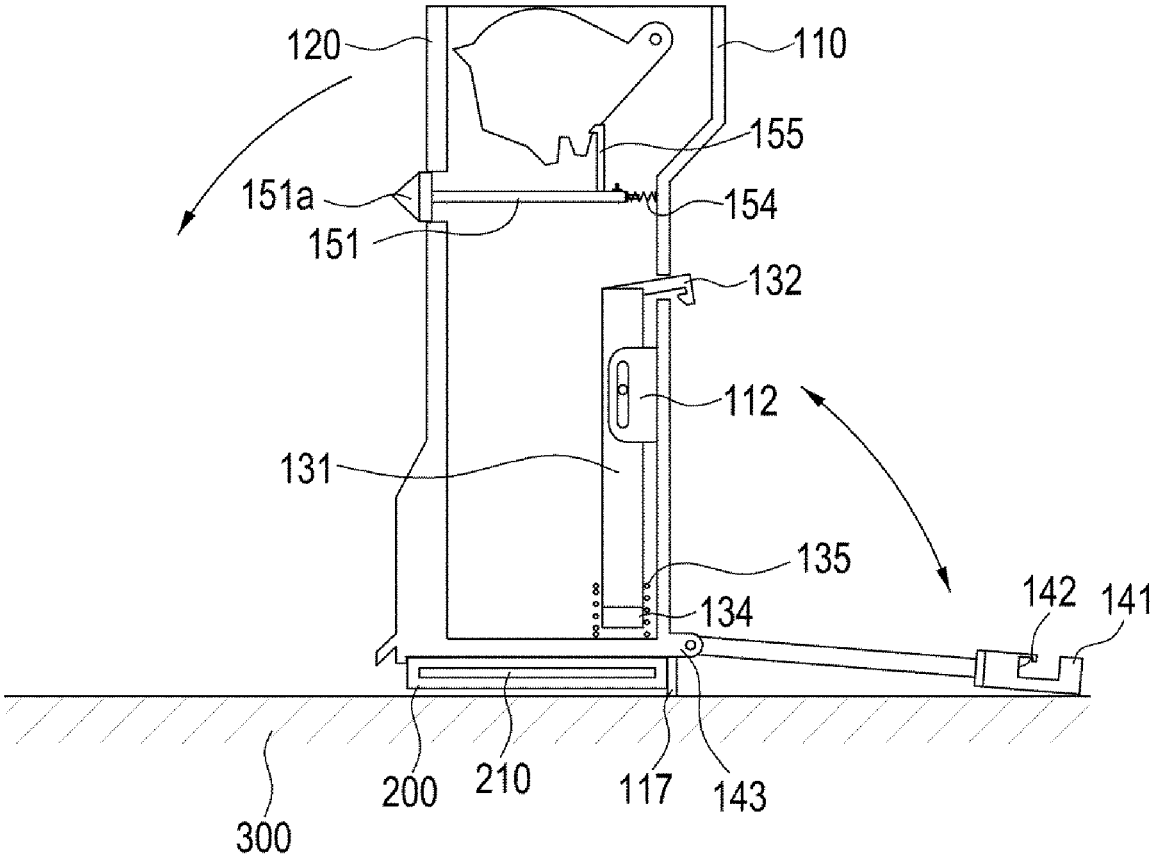
FIG. 4 is a sectional view showing an operating process of the pop-up toy of FIG. 1.
Figure 5:
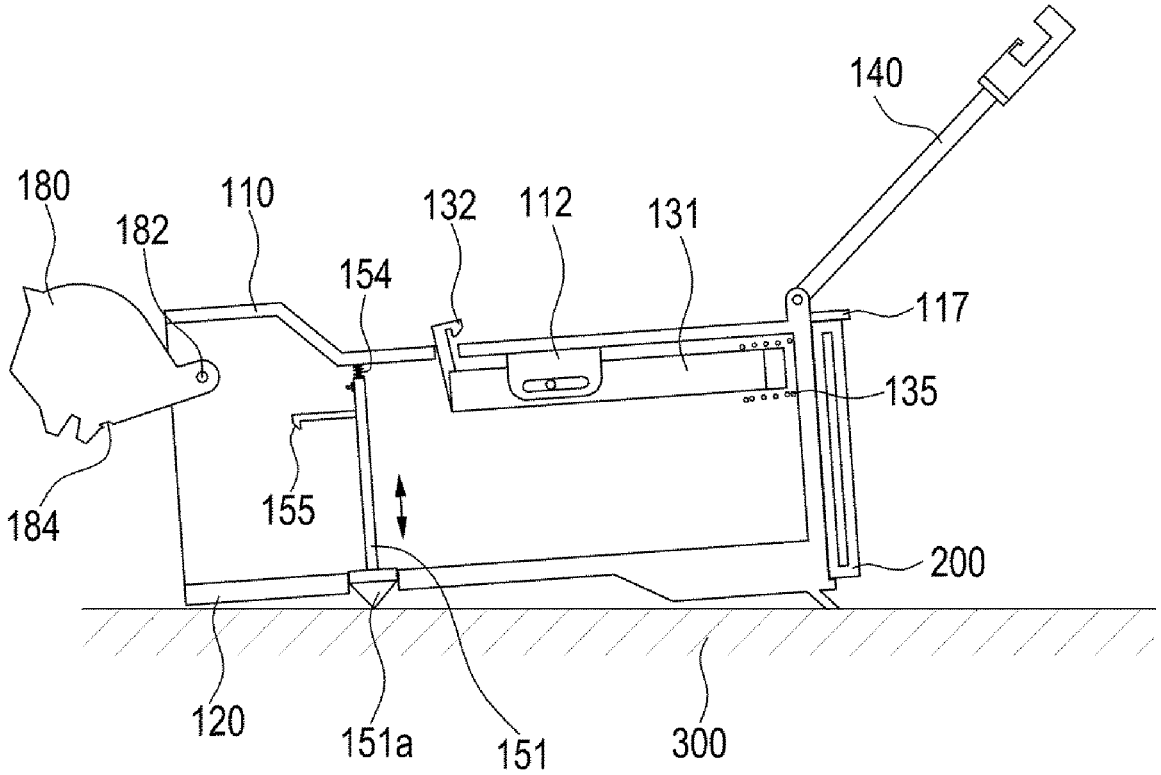
FIG. 5 is a sectional view showing another operating process of the pop-up toy of FIG. 1.
Figure 6:
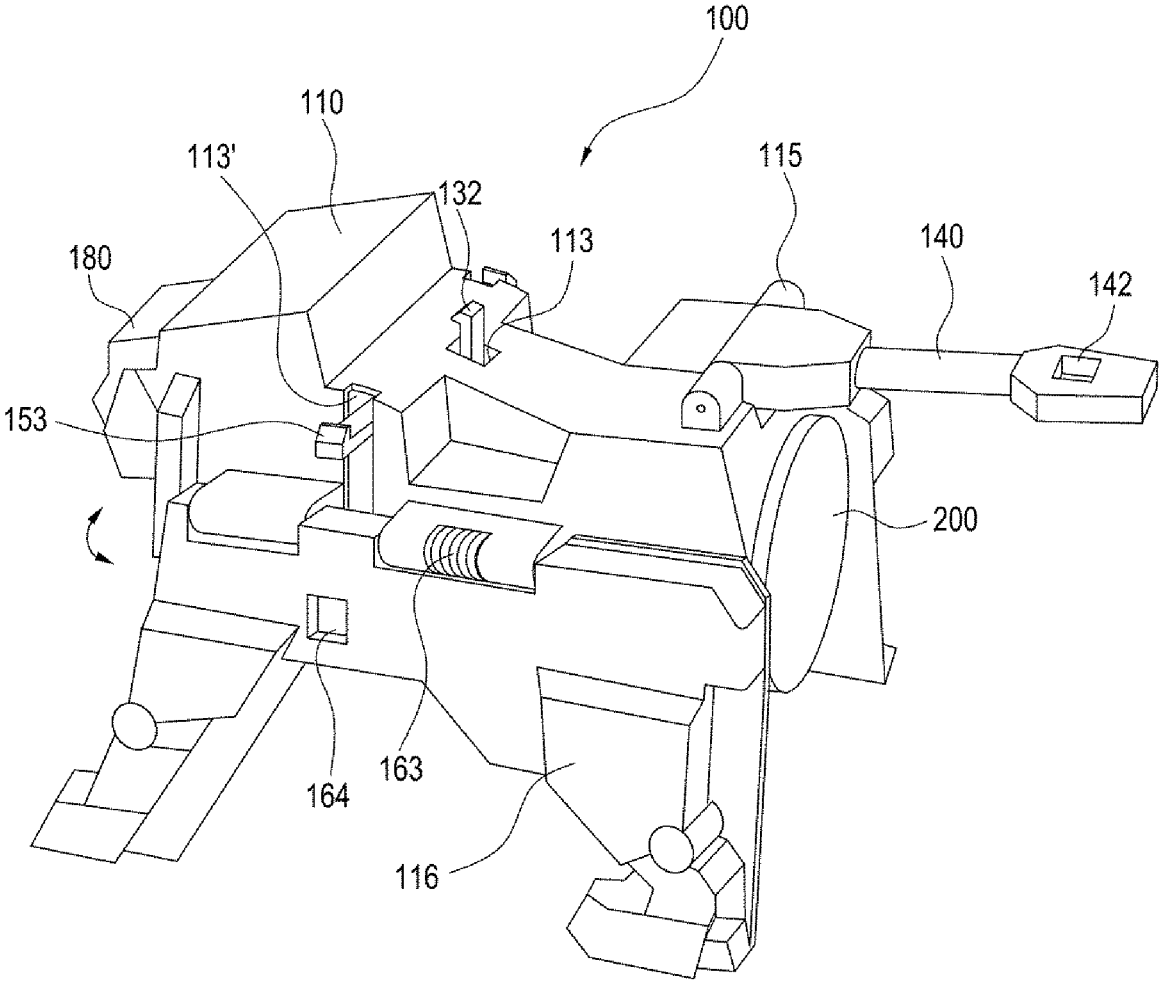
FIG. 6 is a perspective view showing the state where the operation of the pop-up toy of FIG. 1 is finished.

FIG. 1 is a perspective view showing a pop-up toy according to a first embodiment of the present invention, FIG. 2 is an exploded perspective view showing the components of the pop-up toy of FIG. 1, FIG. 3 is a sectional view showing the configuration of the pop-up toy of FIG. 1, FIG. 4 is a sectional view showing an operating process of the pop-up toy of FIG. 1, FIG. 5 is a sectional view showing another operating process of the pop-up toy of FIG. 1, and FIG. 6 is a perspective view showing the state where the operation of the pop-up toy of FIG. 1 is finished.

As shown in FIGS. 1 to 6, a pop-up toy 100 according to a first embodiment of the present invention includes a first body part 110 and a second body part 120 constituting a body having a given form, a first locking part 130 and a second locking part 150 as locking means, a pressurizing part 140, pop-up parts 160 and a head part 180 which are rotatably coupled to the body, and a moving object 200 moving to the pop-up toy 100 to allow the pop-up toy 100 to be released from a locked state, wherein the body having the given form and the pressurizing part 140, the pop-up part 160 and the head part 180 which are rotatably coupled to the body are fixed by means of the locking means to allow an outer form of the pop-up toy 100 to be maintained to a given first form, and if the locking means is operated by means of the moving object 200 moving to the pop-up toy 100 from the outside and is thus released from the locked state thereof, at least one or more body parts of the fixed body parts are developed to allow the outer form of the pop-up toy 100 to transform into a second form from the first form.

Also, the pop-up toy 100 is located at a given position in the state of being maintained to the first form.

That is, the pop-up toy 100 according to the present invention is located at the given position, and if the locking means is released from the locked state by means of the contact with the moving object 200, the pop-up toy 100 transforms into the second form from the first form at the given position.

The first body part 110 is open on one side thereof and has an accommodation space 111 formed at the inside thereof. The first locking part 130, the second locking part 150 and the head part 180 are located in the accommodation space 111.

Further, the first body part 110 includes guides 112 having long holes in such a manner as to be locked onto the first locking part 130, a back surface through hole 113 adapted to pass a portion of the first locking part 130 therethrough, side surface through holes 113' adapted to pass portions of the second locking part 150 therethrough, first coupling members 114 located on both side surfaces thereof in such a manner as to support the pop-up parts 160 to allow the pop-up parts 160 to be rotatably coupled thereto, a second coupling member 115 located on the back surface thereof in such a manner as to support the pressurizing part 140 to allow the pressurizing part 140 to be rotatably coupled thereto, and a third coupling member 116 located on the top surface thereof in such a manner as to support the head part 180 to allow the head part 180 to be rotatably coupled thereto.

Also, the first body part 110 includes a stopper 117 protruding by a given length from the underside thereof in such a manner as to limit the movement of the moving object 200 if the moving object 200 is located under the first body part 110.

The second body part 120 is a plate-shaped member having an arbitrary shape that is located in front of the first body part 110 and has a through hole 121 adapted to pass a portion of the second locking part 150 therethrough.

Further, the second body part 120 has a whole shape providing the first form, and the first form is at least one selected from mask, combat helmet, shield, car, building, and object forms.

The first locking part 130 is located in the first body part 110 to allow the pressurizing part 140 to be maintained to the locked state wherein the pressurizing part 140 comes into close contact with the first body part 110 or to allow the pressurizing part 140 to be separated from the first body part 110 and thus released from the locked state, and the first locking part 130 includes a first locking part body 131, a first locking part latch 132, a rotary shaft 133, a magnet 134, and a first locking part spring 135.

The first locking part body 131 is a bar-shaped member and has protrusions 131*a* protruding by given lengths from both sides thereof in such a manner as to move along the long holes of the guides 112 located on the first body part 110. Further, one side of the first locking part body 131 is coupled to the first locking part latch 132, and the other side thereof to the magnet 134.

One side of the first locking part latch 132 is coupled to the end of the first locking part body 131 by means of the rotary shaft 133, and the other side of the first locking part latch 132 from which a locking protrusion protrudes passes through the back surface through hole 113 of the first body part 110 and is thus fastened to the pressurizing part 140, so that as the first locking part body 131 moves, the locked state is formed wherein the first locking part latch 132 and the pressurizing part 140 are fastened to each other or the lock releasing state is formed wherein the first locking part latch 132 is separated from the pressurizing part 140.

The magnet 134 is located on the other side end of the first locking part body 131 to form a magnetic field together with a magnetic material 210 disposed in the interior of the moving object 200 and to thus generate a magnetic force so that the first locking part body 131 moves along the long holes of the guides 112.

The first locking part spring 135 is located on the other side end of the first locking part body 131 to provide an elastic force to allow the first locking part body 131 to be maintained to a given position, and if the magnetic force generated from the magnet 134 disappears after the first locking part body 131 moves by means of the magnetic force generated from the magnet 134, the first locking part spring 135 provides an elastic force to allow the first locking part body 131 to be returned to its original position.

The pressurizing part 140 is a bar-shaped member that includes a pressurizing part coupling hole 141 formed on one side end portion thereof in such a manner as to be rotatably coupled to the second coupling member 115 of the first body part 110 and a locking slot 142 formed on the other side end portion thereof in such a manner as to be locked onto the first locking part latch 132 and thus fixedly coupled to the first locking part latch 132, thereby being maintained to the locked state.

If the pressurizing part 140 is unlocked from the first locking part latch 132 and is thus released from the locked state, further, it is separated from one side of the first body part 110 and rotates around the second coupling member 115. At this time, the pressurizing part 140 includes a pressurizing part spring 144 adapted to pressurize the ground 300 thereagainst to allow the pop-up toy 100 to fall, for example, forwardly.

According to the present invention, the pressurizing part 140 has a shape of an animal's tail, but it may have various shapes, while being not limited thereto.

According to the present invention, further, the pressurizing part 140 is configured to pressurize the ground 300 thereagainst, but it may be configured to form an arbitrary second form in such a manner as to be exposed and developed through the rotation in the body to allow the second form thereof to be popped up.

The second locking part 150 is located inside the first body part 110 to allow the pop-up parts 160 located on both side surfaces of the first body part 110 to be maintained to the locked states, and if the pop-up toy 100 falls to one side by means of the pressurizing part 140, the second locking part 150 comes into contact with the ground 300 to allow the pop-up parts 160 to be separated from the first body part 110 and thus released from the locked states. The second locking part 150 includes a second locking part body 151, a link member 152, a second locking part latch 153, a second locking part spring 154, and a second locking part auxiliary latch 155.

The second locking part body 151 is a bar-shaped member that includes a contact portion 151*a* formed on one side end portion thereof in such manner as to pass through the through hole 121 of the second body part 120 and the link member 152 disposed on the other side end portion thereof in such a manner as to be rotatably coupled to the second locking part latch 153.

The second locking part latch 153 is rotatably coupled to the second locking part body 151 around the link member 152 and has both side ends from which locking protrusions protrude adapted to pass through the side surface through holes 113' of the first body part 110 in such a manner as to be exposed to the outside of the first body part 110. The second locking part latch 153 is fastened to the pop-up parts 160 coming into close contact with both side surfaces of the first body part 110 to allow the pop-up parts 160 to become locked, or it rotates according to the operation of the second locking part body 151 and is unfastened from the pop-up parts 160 to allow the pop-up parts 160 to be released from the locked states.

The second locking part spring 154 is located on the other side of the second locking part body 151 and provides an elastic force to allow the contact portion 151*a* of the second locking part body 151 to protrude by a given length from the second locking part 120 and also to allow the second locking part latch 153 and the second locking part auxiliary latch 155 to be maintained to given positions. If the pop-up toy 100 falls forwardly to cause the contact portion 151*a* of the second locking part body 151 to come into contact with the ground 300, the second locking part spring 154 becomes compressed by means of the self weight of the pop-up toy 100, and if the compression disappears, the second locking part spring 154 provides the elastic force to allow the second locking part body 151 to be returned to its original position.

The second locking part auxiliary latch 155 is a locking protrusion that protrudes from a given position of the second locking part body 151 and is thus fastened to the head part 180 to allow the head part 180 to be maintained to the locked state. If the second locking part auxiliary latch 155 moves according to the operation of the second locking part body 151, it is unfastened from the head part 180 to allow the head part 180 to be released from the locked state.

The pop-up parts 160 are located on the side surfaces of the first body part 110 and are separated from the first body part 110 to perform pop-up operations for popping up the pop-up toy 100 through the pressurization against the ground 300 if the pop-up toy 100 falls to one side to release the locked state caused by the second locking part 150, and each pop-up part 160 includes pop-up part coupling grooves 161, a pop-up part rotary shaft 162, a pop-up part spring 163, and a locking groove 164.

According to the present invention, the pop-up parts 160 have shapes of an animal's legs, but they may have various shapes, while being not limited thereto.

The pop-up part coupling grooves 161 are fastening grooves adapted to allow the leg-shaped body of each pop-up part 160 to be coupled to a given position of the first body part 110. Also, each pop-up part 160 is rotatably coupled to the first body part 110 by means of the pop-up part rotary shaft 162 fitted to the pop-up part coupling grooves 161.

The pop-up part spring 163 is disposed on the pop-up part rotary shaft 162 to provide an elastic force to allow each pop-up part 160 to rotate around the pop-up part rotary shaft 162, so that each pop-up part 160 pressurizes the ground 300 thereagainst by means of the elastic force and thus performs the pop-up operation for popping up the pop-up toy 100.

The locking groove 164 is a coupling groove formed on one side of the body of each pop-up part 160 in such a manner as to be fastened to the second locking part latch 153 of the second locking part 150 to allow each pop-up part 160 to be fixed to the corresponding side surface of the first body part 110.

The head part 180 is rotatably coupled to the first body part 110 and is popped up from the inside of the first body part 110 to the outside thereof if the pop-up toy 100 falls to one side to release the locked state of the second locking part 150. The head part 180 has a shape of a given animal or character's face formed on one side thereof and a head coupling member 181 located on the other side thereof in such a manner as to be rotatably coupled to the first body part 110 around a head part rotary shaft 182.

Further, the head part 180 includes a head part spring 183 located on the head part rotary shaft 182 to provide an elastic force to allow the head part 180 to rotate around the head part rotary shaft 182 if the locked state between the locking grooves 164 of the pop-up parts 160 and the second locking part 150 is released.

The second form is at least one selected from animal, robot, human, and animation character forms, and of course, it is obvious that it may be changed into arbitrary other forms.

The moving object 200 is a plate-shaped member having any one selected from circular, oval, and polygonal outer shapes, and desirably, it is made of a synthetic resin. Further, the moving object 200 has at least one selected from a magnetic material 210 and a magnet disposed in the interior thereof to form a magnetic field together with the magnet 134.

Further, the moving object 200 has a given character, numbers, text, figure, and pattern printed on the outer surface thereof or formed by means of depressed engraving or embossed carving.

Also, the moving object 200 is pushed to move to a direction where the pop-up toy 100 is located, while being placed on the ground 300. Otherwise, the moving object 200 is located at a given launcher and is thus shot toward the direction where the pop-up toy 100 is located.

In case where the moving object 200 is shot using the launcher, at least one or more moving objects 200 are accommodated in the launcher, and next, a firing pin disposed in the launcher is pressurized by means of a user to sequentially shoot the moving objects 200 accommodated in the launcher. Otherwise, the firing pin is pressurized by means of an elastic force to sequentially shoot the moving objects 200 accommodated in the launcher.

Next, an explanation on the operation process of the pop-up toy 100 according to the first embodiment of the present invention will be given.

First, the pressurizing part 140 in the pop-up toy 100, which completely transforms into the second form as shown in FIG. 2, rotates around the pressurizing part rotary shaft 143 and is thus coupled to the first locking part latch 132 protruding from the back surface through hole 113 of the first body part 110. The pop-up parts 160 rotate around the pop-up part rotary shafts 162 and are thus coupled to the second locking part latch 153 protruding from the side surface through holes 113' of the first body part 110. The head part 180 rotates around the head part rotary shaft 182 in such a manner as to be located inside the first body part 110 and then coupled to the second locking part auxiliary latch 155. As a result, the pop-up toy 100 has the first form as shown in FIG. 1, in which the locked state is maintained.

If the moving object 200 is shot toward the pop-up toy 100 after the pop-up toy 100 having the first form has been located at a given position, the moving object 200 moves to the underside of the pop-up toy 100 along the ground 300.

At this time, the surface printed on the moving object 200 with the information such as the given character, numbers, text, figure and pattern is located to face the ground 300.

If the moving object 200 moves to the underside of the pop-up toy 100, it does not move anymore by means of the stopper 117, and at this time, attraction is generated from the magnetic field between the magnet 134 mounted on the first locking part 130 and the magnetic material 210 disposed inside the moving object 200 to allow the first locking part body 131 to move downwardly along the guides 112.

If the first locking part body 131 moves downwardly, the first locking part latch 132 connected to the first locking part body 131 by means of the rotary shaft 133 is operated and is thus released from the locked state onto the pressurizing part 140.

If the locked state of the pressurizing part 140 is released, the pressurizing part 140 rotates around the pressurizing part rotary shaft 143 by means of the elastic force of the pressurizing part spring 144 and thus hits the ground 300. Through the hitting, accordingly, the pop-up toy 100 falls to the opposite direction to the rotating direction of the pressurizing part 140.

If the pop-up toy 100 falls, the second locking part body 151 connected to the contact portion 151*a* is pressurized, and the second locking part latch 153 connected to the second locking part body 151 is operated according to the movement of the second locking part body 151 and is thus released from the locked state onto the pop-up parts 160.

If the locked states of the pop-up parts 160 are released, the pop-up parts 160 rotate around the pop-up part rotary shafts 162 by means of the elastic forces of the pop-up part springs 163 and thus hit the ground 300. Through the hitting, accordingly, the pop-up toy 100 is popped up and thus stands up.

If the pop-up toy 100 falls, also, the second locking part body 151 connected to the contact portion 151*a* is pressurized, and the second locking part auxiliary latch 155 connected to the second locking part body 151 is operated and is thus released from the locked state onto the head part 180.

If the locked state of the head part 180 is released, the head part 180 rotates around the head part rotary shaft 182 by means of the elastic force of the head part spring 183 and is thus popped up from the inside of the first body part 110 to the outside thereof, thereby allowing the pop-up toy 100 to transform into the second form.

If the locked state is released by means of the first locking part 130, the pop-up toy 100 according to the first embodiment of the present invention falls to one side, and if the locked state is released by means of the second locking part 150, the pop-up toy 100 according to the first embodiment of the present invention is popped up and thus stands up. However, the present invention is not limited to the above-mentioned manner, and accordingly, the pop-up toy 100 may transform into the second form if the locked state is released by means of the first locking part 130.

If the second locking part 150 comes into contact with the ground 300 and is thus released from the locked state, further, at least one or more body parts of the pop-up toy 100 rotate to pop up a second form accommodated in the pop-up toy, and otherwise, an arbitrary body portion accommodated in the body part may be thrown to the outside of the body part by means of the rotating forces caused by at least one or more body parts or may be shot toward the outside of the body part by means of the elastic forces of springs accommodated therein.

Also, the pop-up toy 100 is popped up in the state where the moving body 200 is attached to the first locking part 130, and accordingly, the underside of the moving body 200 is exposed from one side of the pop-up toy 100 transformed into the second form, so that the information printed on the surface of the moving body 200 like the character, numbers, text, figure and pattern can be seen to the outside.

Second Embodiment

Figure 7:
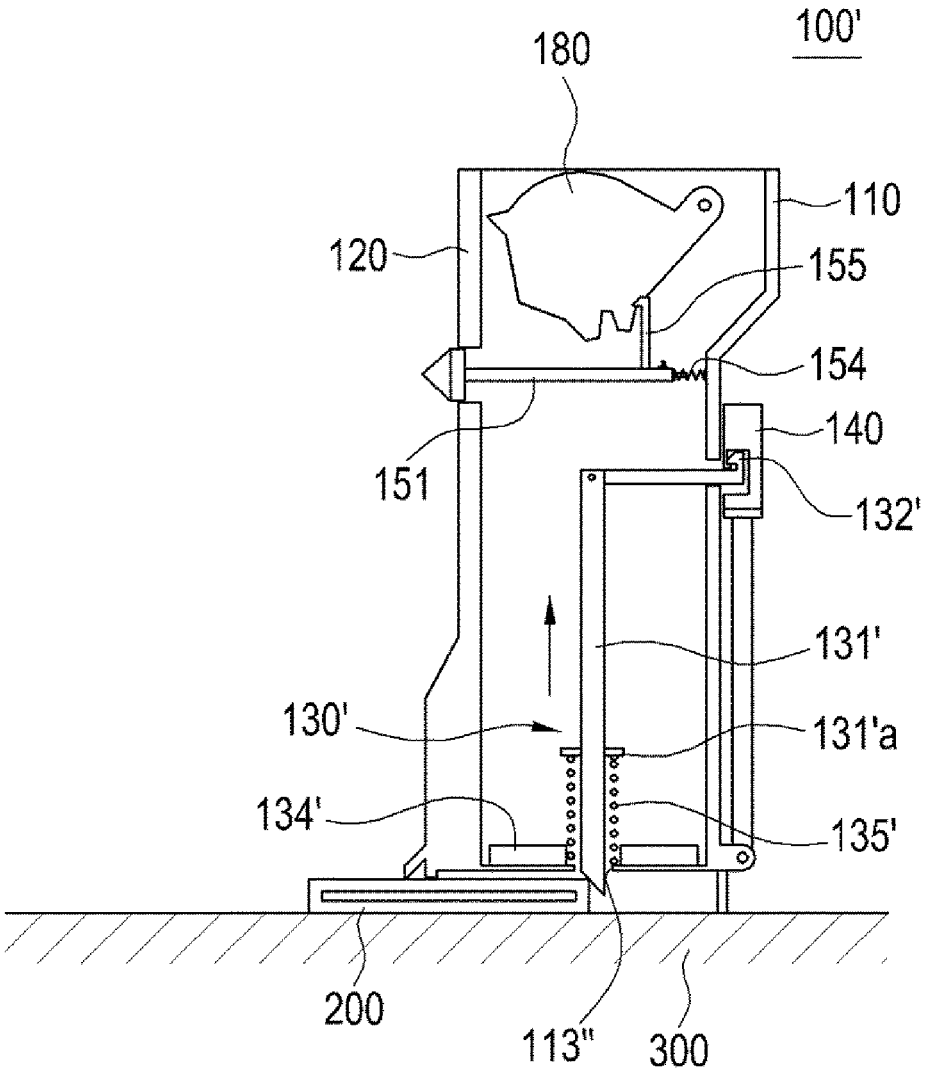
FIG. 7 is a sectional view showing a pop-up toy according to a second embodiment of the present invention.
Figure 8:
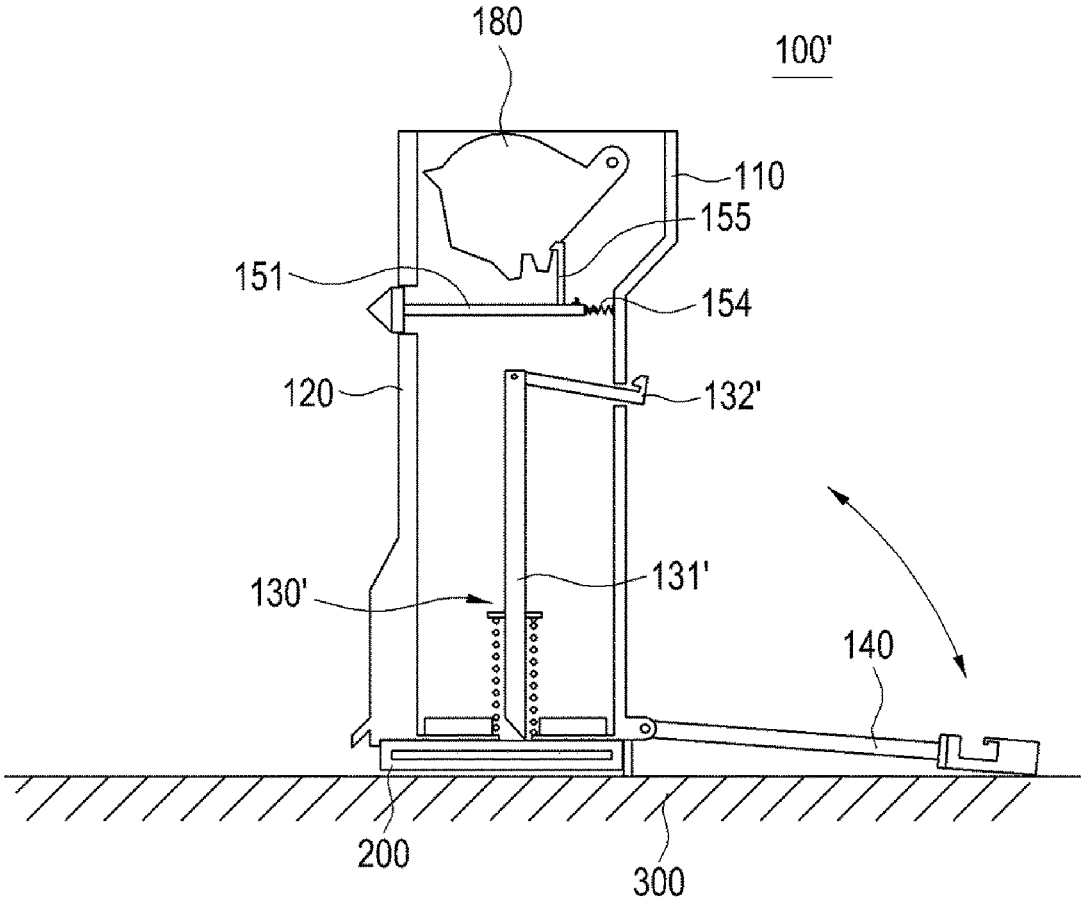
FIG. 8 is a sectional view showing an operating process of the pop-up toy of FIG. 7.

FIG. 7 is a sectional view showing a pop-up toy according to a second embodiment of the present invention, and FIG. 8 is a sectional view showing an operating process of the pop-up toy of FIG. 7.

As shown in FIGS. 7 and 8, a pop-up toy 100' according to a second embodiment of the present invention includes a first body part 110, a second body part 120, a first locking part 130', a pressurizing part 140, a second locking part 150, pop-up parts 160, a head part 180, and a moving object 200, wherein the first locking part 130' and the second locking part 150 are provided to maintain an outer form of the pop-up toy 100' to a first form, and if the first locking part 130' and the second locking part 150 are operated by means of the contact with the moving object 200 moving from the outside and are thus released from the locked states thereof, the outer form of the pop-up toy 100' transforms into a second form from the first form.

The pop-up toy 100' according to the second embodiment of the present invention is differently configured from the pop-up toy 100 according to the first embodiment of the present invention. On the other hand, the repeated explanation on the same parts as the pop-up toy 100 according to the first embodiment of the present invention will be avoided for the brevity of the description, and the corresponding parts in the first and second embodiments of the present invention are indicated by corresponding reference numerals.

The first locking part 130' is adapted to allow the pressurizing part 140 to be maintained to the locked state and also to allow the locked state of the pressurizing part 140 to be released by means of the physical contact with the moving object 200. The first locking part 130' includes a first locking part body 131', a first locking part latch 132', a rotary shaft 133', a magnet 134', and a first locking part spring 135'.

The first locking part body 131' has one end portion protruding therefrom in such a manner as to pass through a back surface through hole 113' of the underside of the first body part 110, and the end of the protruding one end portion of the first locking part body 131' is slantly formed and thus physically contacted with the moving object 200, so that the first locking part body 131' moves upwardly.

One side of the first locking part latch 132' is coupled to the end of the first locking part body 131' by means of the rotary shaft 133', and the other side of the first locking part latch 132' from which a locking protrusion protrudes passes through the back surface through hole 113 of the first body part 110 and is thus fastened to the pressurizing part 140, so that as the first locking part body 131' moves upwardly and downwardly, the locking state is formed wherein the first locking part latch 132' and the pressurizing part 140 are fastened to each other or the lock releasing state is formed wherein the first locking part latch 132' is separated from the pressurizing part 140.

The magnet 134' is located on the lower end of the first body part 110 to form a magnetic field together with the magnetic material 210 disposed in the interior of the moving object 200, so that the moving object 200 is attached to the underside of the first body part 110 in such a manner as to be attached to the pop-up toy 100'.

The first locking part spring 135' is located on the other side end of the first locking part body 131' to provide an elastic force to allow the first locking part body 131' to be maintained to a given position, and if the contact with the moving object 200 disappears after the first locking part body 131' moves by means of the physical contact with the moving object 200, the first locking part spring 135' provides the elastic force to allow the first locking part body 131' to be returned to its original position.

Accordingly, if the pop-up toy located at the given position is attached to the moving object moving from the given position, the pop-up toy transforms into the second form from the first form, thereby improving the excitement in the play.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In the description, the thicknesses of the lines or the sizes of the components shown in the drawing may be magnified for the clarity and convenience of the description. Further, the terms as will be discussed later are defined in accordance with the functions of the present invention, but may be varied under the intention or regulation of a user or operator. Therefore, they should be defined on the basis of the whole scope of the present invention.

*Explanations on Reference Numerals*

| | |
|---|---|
| 100: pop-up toy | 110: first body part |
| 111: accommodation space | 112: guide |
| 113: back surface through hole | |
| 114: first coupling member | |
| 115: second coupling member | |
| 116: third coupling member | |
| 120: second body part | 121: through hole |
| 130: first locking part | |
| 131: first locking part body | |
| 131a: protrusion | 132: first locking part latch |
| 133: rotary shaft | 134: magnet |
| 135: first locking part spring | |
| 140: pressurizing part | |
| 141: pressurizing part coupling hole | |
| 142: locking slot | |
| 143: pressurizing part rotary shaft | |
| 144: pressurizing part spring | 150: second locking part |
| 151: second locking part body | |
| 151a: contact portion | 152: link member |
| 153: second locking part latch | |
| 154: second locking part spring | |
| 155: second locking part auxiliary latch | |
| 160: pop-up part | |
| 161: pop-up part coupling groove | |
| 162: pop-up part rotary shaft | |
| 163: pop-up part spring | 164: locking groove |
| 180: head part | 181: head coupling member |
| 182: head part rotary shaft | 183: head part spring |
| 200: moving object | 210: magnetic material |

The invention claimed is:

1. A pop-up toy, comprising:

a body;

body parts rotatably coupled to the body;

a moving part configured to move from an outside of the body toward the body and respond to a first locking part disposed in the moving part to allow the first locking part to be released from a locked state;

the first locking part configured to:

maintain the locked state by being coupled to the body parts to maintain an outer shape of the body in a first shape, and be released from the locked state in response to a movement of the moving part, wherein the first locking part released from the locked state causes one of the body parts to press ground through rotation, causing the body to fall over to one side and the outer shape of the body to be transformed into a second shape;

a second locking part configured to be unlocked in response to the first locking part being released from the locked state; and a pop-up part rotatably coupled to the body, and configured to cause the body that is transformed into the second shape to pop up in response to the second locking part being released.

2. The pop-up toy of claim 1, wherein the pop-up toy is located at a given position, and wherein the moving part is further configured to move from an outside of the pop-up toy toward the first locking part.

3. The pop-up toy of claim 1, wherein the pop-up toy is configured such that when the second locking part moves to an unlocking position, at least one of the body parts that are rotatably coupled to the body is rotated and at least one part is enabled to be thrown or shot to an outside of the body.

4. The pop-up toy of claim 1, wherein the moving part has a magnetic material disposed in an interior thereof.

5. The pop-up toy of claim 4, wherein the first locking part has a magnet mounted thereon that is configured to be influenced by the magnetic material disposed in the interior thereof and through attraction caused by a magnetic field to release the first locking part from the locked state.

6. The pop-up toy of claim 4, wherein the first locking part is configured to be released from the locked state in response to physical contact with the moving part.

7. The pop-up toy of claim 6, wherein the first locking part has the magnetic material disposed in the moving part and a magnet forming a magnetic field so as to allow the moving part in physical contact therewith to be attached to the pop-up toy.

8. The pop-up toy of claim 1, further comprising a stopper disposed under the first locking part and configured to limit a movement of the external object.

9. The pop-up toy of claim 1, wherein the first form includes any one or any combination of any two or more of a mask, a combat helmet, a shield, a car, and a building.

10. The pop-up toy of claim 1, wherein the second form includes any one or any combination of any two or more of an animal, a robot, a human, and a form of an animation character.

* * * * *